United States Patent [19]

Neil

[11] Patent Number: 4,557,630

[45] Date of Patent: Dec. 10, 1985

[54] VIBRATORY CLAMPING DEVICE FOR USE WITH AN EXCAVATOR IN SUPPORTING AND PLACING SHEETING WHEN EXCAVATING IN SAND, RUNNING SAND AND SILT

[76] Inventor: Joseph S. Neil, 270 Cameron Crescent, Bonnyrigg, Midlothian, Scotland

[21] Appl. No.: 619,267

[22] Filed: Jun. 11, 1984

[51] Int. Cl.[4] ..... E02D 7/20

[52] U.S. Cl. ..... 405/232; 173/131; 269/25; 269/46; 279/4; 405/278

[58] Field of Search ..... 405/231, 232, 274, 278, 405/275–277; 173/131, 132, 127; 414/620; 279/4; 269/46, 25

[56] References Cited

U.S. PATENT DOCUMENTS

| | | | |
|---|---|---|---|
| 2,947,275 | 8/1960 | Edmonds | 269/25 |
| 2,976,034 | 3/1961 | Hiatt | 269/46 |
| 3,101,956 | 8/1963 | Muller | 405/278 X |
| 3,149,851 | 9/1964 | Adams | 173/131 X |
| 3,243,190 | 3/1966 | Peregrine | 279/4 |
| 3,279,195 | 10/1966 | Taylor | 405/232 |
| 3,396,980 | 8/1968 | Muller | 279/4 X |
| 3,550,694 | 12/1970 | Gawlik | 173/131 |
| 3,889,482 | 6/1975 | Frederick | 405/274 |
| 3,970,342 | 7/1976 | Cotton | 414/620 X |

*Primary Examiner*—Dennis L. Taylor

*Attorney, Agent, or Firm*—Mason, Fenwick & Lawrence

[57] ABSTRACT

A first portion of the device is suspended by a head from the mounting for an excavator bucket and comprises a first jaw and a guideway. A second portion of the device comprises a second jaw and a slide slidable within the guideway under the control of a hydraulically operated ram. Pins extend from the upper end of the second jaw and can extend through respective holes in sheeting held between the jaws and into respective holes in the upper end of the first jaw. Opposing plates are resiliently mounted on the respective jaws for engagement with the opposite sides of the sheeting. Vibratory means mounted on the second jaw vibrates the plate and thus the other plate and the sheeting therebetween.

5 Claims, 3 Drawing Figures

VIBRATORY CLAMPING DEVICE FOR USE WITH AN EXCAVATOR IN SUPPORTING AND PLACING SHEETING WHEN EXCAVATING IN SAND, RUNNING SAND AND SILT

This invention relates to a vibratory clamping device for use with an excavator in supporting and placing sheeting when excavating in sand, running sand and silt.

It is known to hold up the walls of excavations in such ground by the use of sheet-piling in which sheeting is hammered into the ground by means, for example, of the underside of the excavator bucket or of a jack hammer. A disadvantage of this method resides in the possibility of damage being done to the sheeting by the hammering particularly when a considerable amount of water is present in the ground and causes the sheeting to rebound after each impact.

An object of the invention is to obviate or mitigate the above disadvantage.

According to the invention there is provided a vibrating clamping device for use with an excavator in supporting and placing sheeting when excavating in sand, running sand and silt, the device comprising a first portion adapted to be suspended from the mounting for the excavator bucket and including a first jaw and a guideway, a second portion including second jaw and a slide slidable within the guideway in moving the second jaw towards and away from the first jaw, formations on one of the jaws for engagement with corresponding formations on the sheeting to enable the sheeting to be suspended between the jaws, opposing plates resiliently mounted on the respective jaws for engagement with opposite sides of the sheeting, vibratory means mounted on one of the jaws for vibrating the plate mounted on that jaw so that when the jaws are closed on the sheeting both plates and the sheeting engaged therebetween are vibrated, and means for moving the second jaw towards and away from the first jaw.

An embodiment of the invention will now be described, by way of example, with reference to the accompanying drawings, in which.

Figure 1:
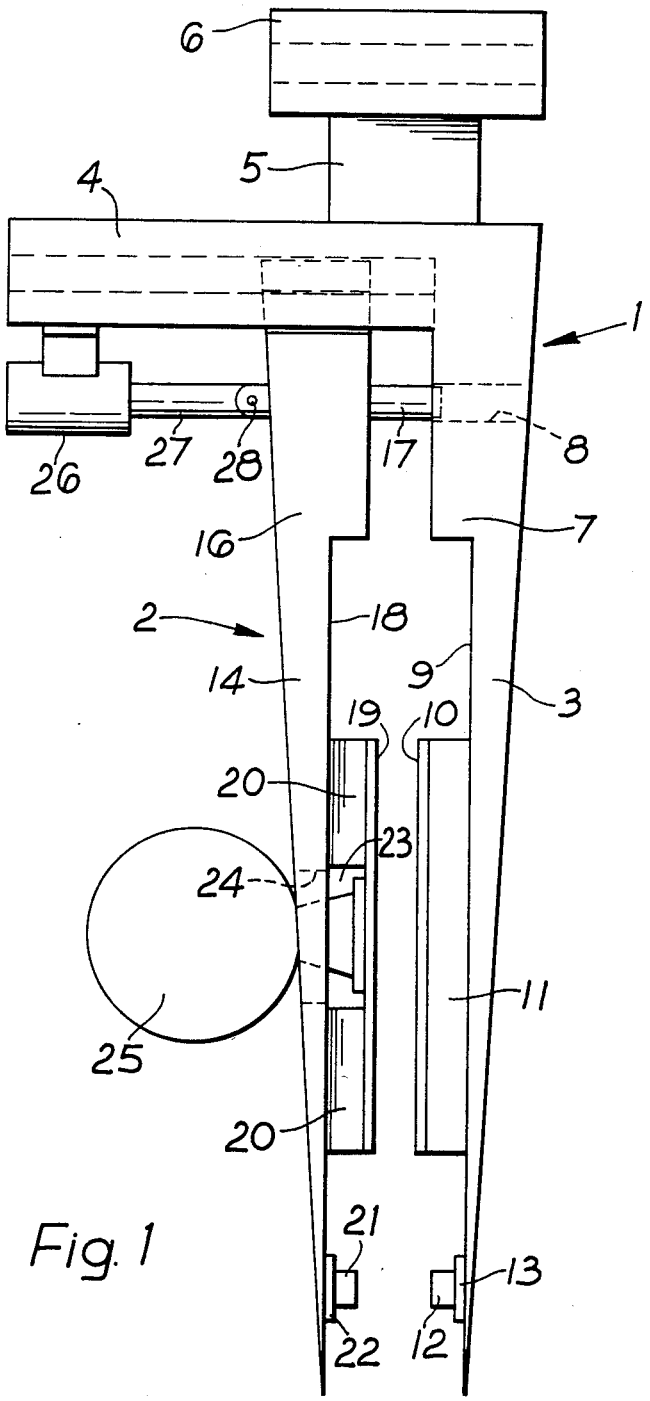
FIG. 1 is a side elevation of a vibratory clamping device.

In the drawings, the device comprises a first portion generally designated 1 and a second portion generally designated 2. The portion 1 includes a first jaw 3 and a guideway 4 extending laterally from the upper end of the jaw 3. A neck 5 extends upwards from the guideway 4 and terminates in a head 6 similar in cross-section to the guideway 4 but inverted relatively thereto. The purpose of the head 6 will be explained later. Through the upper end 7 of the jaw 3 four holes 8 are bored. Below the end 7 the inwardly facing surface 9 of the jaw 3 is relieved. A rectangular plate 10 is mounted on the surface 9 via springs (not shown) encapsulated in rubber 11. Below the plate 10 also mounted on the surface 9 is a pad 12 via rubber 13.

The portion 2 includes a second jaw 14 surmounted by a slide 15 slidable within the guideway 4. From the upper end 16 of the jaw 14 four pins 17 extend into the respective holes 8. Below the end 16 the inwardly facing surface 18 of the jaw 14 is relieved in the same way as the surface 9 of the jaw 3. A rectangular plate 19 is mounted opposite the plate 10 on the surface 18 via springs (not shown) encapsulated in rubber 20. Below the plate 19 also mounted on the surface 18 and opposite the pad 12 is a pad 21 via rubber 22. The rubber 20 is interrupted to leave a space 23 communicating with an opening 24 through the jaw 14. A rotary unbalanced vibrator 25 is mounted directly on the plate 19 through the opening 24 and the space 23. The vibrator 25 may be electrically or hydraulically driven. Alternatively the vibrator may be in the form of a hydraulically-operable percussive device of which the housing is mounted on the jaw 14 itself and the plate 19 constitutes an anvil for a hammer portion of the percussive device.

Figure 2:
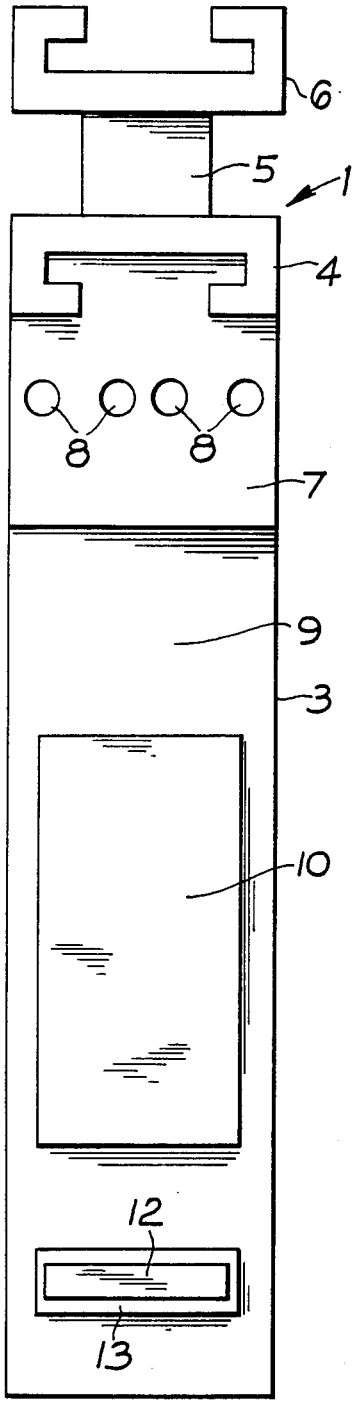
FIG. 2 is an elevation of a first portion of the device viewed from the left in FIG. 1.
Figure 3:
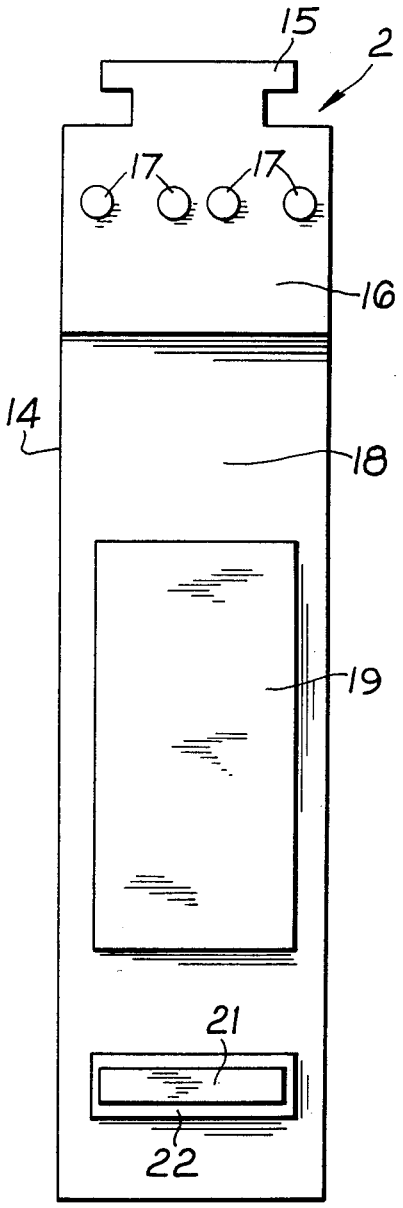
FIG. 3 is an elevation of a second portion of the device viewed from the right in FIG. 1.

In order to move the jaw 14 towards and away from the jaw 3, a hydraulically-operated ram 26 is mounted under the guideway 4. The piston rod 27 of the ram 26 is connected at 28 to the jaw 14. The ram 26 has been omitted from FIG. 2 for the sake of clarity.

The head 6 is designed to be slid onto one end of a cross-beam (not shown) adapted to be swivellably suspended mid-way of its length from the mounting usually provided for the bucket of an excavator. A second vibratory clamping device, identical to the one described, is slid onto the other end of the cross-beam to provide a tandem arrangement suspended from a simple excavator. The two heads 6 are fixed to the cross-beam symmetrically at a desired spacing and with the vibrators facing each other for placing sheeting on both sides of a trench simultaneously.

In an alternative embodiment the head 6 may be replaced by means for swivellably suspending the portion 1 directly from the mounting usually provided for the bucket of an excavator.

Before placing the sheeting a shallow trench is dug to a depth insufficient to result in collapse of the trench walls but sufficient to accommodate at least initially the vibrator(s). The bucket of the excavator is then removed and either a tandem arrangement of vibratory clamping devices or a single vibratory clamping device is mounted in place of the bucket. Sheeting is then disposed between the jaws 1 and 2 with the pins 17 inserted through holes in the sheeting. The jaws are then closed on the sheeting by the ram 26 so that the upper ends 7 and 16 clamp the sheeting between them and the plates 10 and 19 and the pads 12 and 21 engage opposite sides of the sheeting. Thereafter the sheeting is suspended over the desired location and simultaneously pressed into the ground by its own weight and by the excavator and vibrated by the vibrator. The sheeting is selected in its depthwise dimension so that when its upper edge is level with the unexcavated ground its lower edge is lower than the final floor of the trench. Further excavation of the trench to the final depth is performed with the upper portions of the sheeting on opposite sides of the trench being held apart by hydraulically-operated or screw jacks and the lower edges of the sheeting anchored in the ground. The sheeting can be removed by simultaneously lifting and vibrating. Placing and removal of the sheeting is facilitated by finely tapering the jaws 3 and 14 as shown in FIG. 1.

The hydraulic operation of the ram 26 and the vibrator (when applicable) can be effected from the hydraulic system of the excavator.

I claim:

1. A vibratory clamping device for use with an excavator in supporting and placing sheeting when excavating in sand, running sand and silt, the device comprising a first portion adapted to be suspended from the mounting for the excavator bucket and including a first jaw and a guideway, a second portion including second jaw and a slide slidable within the guideway in moving the second jaw towards and away from the first jaw, formations on one of the jaws for engagement with corresponding formations on the sheeting to enable the sheeting to be suspended between the jaws, opposing plates resiliently mounted on the respective jaws for engagement with opposite sides of the sheeting, vibratory means mounted on one of the jaws for vibrating the plate mounted on that jaw so that when the jaws are closed on the sheeting both plates and the sheeting engaged therebetween are vibrated, and means for moving the second jaw towards and away from the first jaw.

2. A device according to claim 1, wherein the formations on one of the jaws are pins which can extend through respective holes in the sheeting and into respective holes in the other jaw.

3. A device according to claim 1, wherein both jaws are finely tapered downwards when the device is in use.

4. A device according to claim 1, wherein the first portion is adapted to be suspended from the mounting for the excavator bucket by being provided with a head designed to be slid onto a cross-beam adapted to be swivellably suspended from the mounting.

5. A device according to claim 1, wherein the first portion is adapted to be swivellably suspended directly from the mounting for the excavator bucket.

* * * * *